United States Patent [19]

Marklund

[11] 4,441,659

[45] Apr. 10, 1984

[54] ARRANGEMENT IN DRUM MILLS

[76] Inventor: Olle E. Marklund, Risgatan 8, S-930 50 Boliden, Sweden

[21] Appl. No.: 207,795

[22] Filed: Nov. 17, 1980

[30] Foreign Application Priority Data

Nov. 30, 1979 [SE] Sweden ..... 7909921

[51] Int. Cl.[3] ..... B02C 17/00

[52] U.S. Cl. ..... 241/70; 241/79.3; 241/97; 241/171; 241/284

[58] Field of Search ..... 241/70, 71, 72, 79.2, 241/79.3, 97, 171, 284

[56] References Cited

U.S. PATENT DOCUMENTS 3,078,050 2/1963 Hardinge ..... 241/26
3,231,203 1/1966 Hardinge et al. ..... 241/24
3,924,814 12/1975 Fahlström ..... 241/180

FOREIGN PATENT DOCUMENTS 417164 7/1974 U.S.S.R. ..... 241/70

*Primary Examiner*—Mark Rosenbaum
*Assistant Examiner*—Timothy V. Eley
*Attorney, Agent, or Firm*—Stevens, Davis, Miller & Mosher

[57] ABSTRACT

A drum mill intended for autogenous or semi-autogenous wet-grinding processes has a screening wall, which is arranged adjacent an end wall provided with a hollow material-discharge trunnion and which separates said end wall from the grinding space, whereat said screening wall has at least one first group of relatively small grate openings through which fine material ground in the mill constantly leaves the grinding space and departs through the discharge trunnion, and at least one second group of relatively large openings through which mixed material, comprising both fine and coarse material, can leave the grinding space. This second group of openings communicates with an individual material outlet via a switching means by which the material mixture passing through said second group of openings can be prevented from leaving the mill. The mill is also provided with classifying means for dividing said material mixture upstream of the outlet therefore into at least one coarse fraction and at least one finer fraction having a maximum particle size which is equal to or greater than the mazimum particle size of said fine material. To avoid disturbances in the grinding process, means are also provided for returning at least the major part of said finer fraction to the grinding space.

9 Claims, 4 Drawing Figures

13
12
14
10
15
11
19
23
17
16
18
33
27
28
51
II
37
25
54
31
35
24
38
40
39
26
34
36
41
43
42
52
53
50
II
29
22
30
32

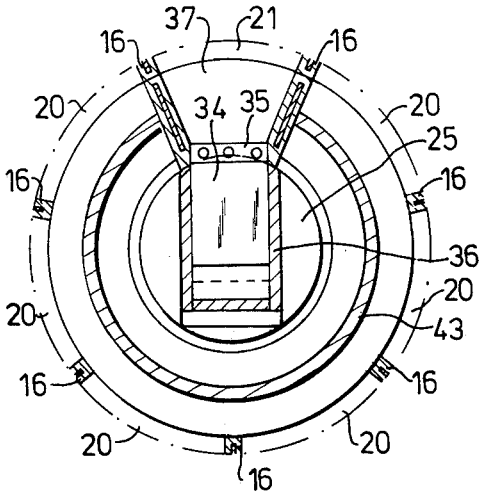
Fig. 2
Fig. 3
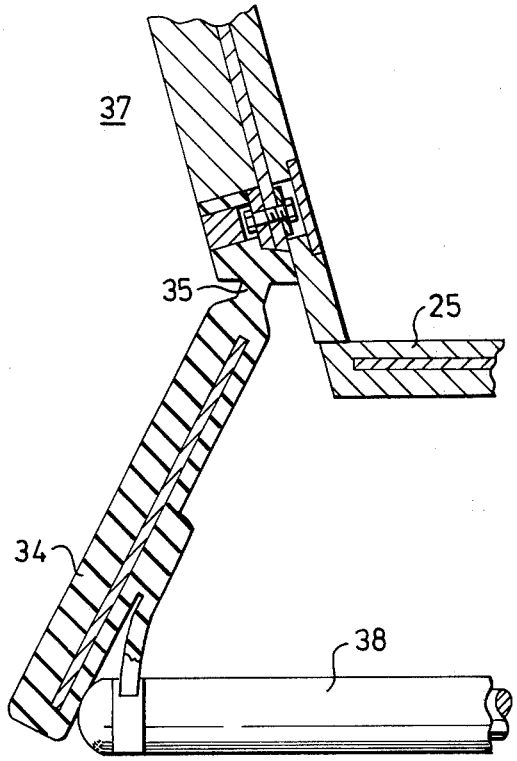

ARRANGEMENT IN DRUM MILLS

The present invention relates to an arrangement in drum mills for autogenous or semi-autogenous wet-grinding processes.

From, for example, U.S. Pat. Nos. 3,078,050 and 3,231,203, there are known arrangements in drum mills for primary autogenous grinding for continuously discharging from the grinding space of the mill a fine material ready-ground in the mill, and a material mixture containing fine material, coarse material and material whose particle size lies therebetween, said fine material and said mixture being brought together in or externally of a hollow material-discharge trunnion in one end wall of the primary mill, whereafter all material is classified in a classifying means connected to said discharge trunnion. The classifying means may be stationary, although preferably it is attached to and rotates with the discharge trunnion of the primary mill.

Normally, the material is classified so that said coarse material lies within a particle range, e.g. a smallest cross-dimension of about 25–80 mm, such as to enable said coarse material to be used as grinding media in a secondary autogenous mill for further grinding of the said fine material in which case the coarse material is passed to the secondary mill, optionally via a storage bin. Material which has an intermediate particle size, e.g. a smallest cross-dimension of about 5–25 mm, and which cannot to advantage be further ground while using the coarse material as grinding media is normally passed through a screen and returned to the primary mill or passed to an intermediate mill, such as a rod mill, particularly suited for grinding such intermediate size material, from which mill ground material is passed to the secondary mill. When using a co-rotating classifying means, said means can be provided with means, whereby the removal of classified coarse material can be controlled, whereat means are also provided for returning coarse material taken out from the grinding space of the primary mill, but not taken out from the classifying means, back to said grinding space. Arrangements of the aforedescribed kind, however, require a lot of space and are subjected to a great deal of wear, since material mixture is constantly taken from the grinding space and must be classified together with all the fine material removed, irrespective of whether a large quantity of coarse material is removed from the primary mill, a small quantity or none at all.

To avoid the aforementioned disadvantages arrangements of the aforedescribed kind have been developed. See for example U.S. Pat. No. 3,924,814, in which fine material and material mixture removed from the grinding space are held separated, so that only the material mixture need be classified. In this way the classifying means need have only small dimensions, such as to allow said means to be accommodated substantially within the discharge trunnion. Thus, the classifying means is only subjected to a small amount of wear, since in practice only a small part of the total amount of material taken from the grinding space of the primary mill, e.g. only about 10% of the total amount of material removed, need be classified in said means. The arrangements of the kind last mentioned, however, are also encumbered with disadvantages, originating from the fact that the flow of fine material from the mill greatly increases during those periods in which material mixture is taken from the mill. This disturbs the grinding process both in said mill and in any mill which may be arranged downstream of the first mentioned mill and in which the fine material is subjected to a further grinding operation, using the coarse material present in said material mixture as grinding media.

The object of the invention is therefore to devise a new and beneficial arrangement, whereby all above-mentioned disadvantages are at least to a substantial degree eliminated.

To this end, there is proposed in accordance with the invention an arrangement in drum mills intended for autogenous or semi-autogenous wet-grinding processes and being of the type having a screening wall which is arranged adjacent an end wall provided with a hollow material-discharge trunnion and which separates said end wall from the grinding space. The screening wall has at least one first group of relatively small grate openings through which fine material ground in the mill constantly leaves the grinding space and departs through the discharge trunnion, and at least one second group of relatively large openings through which mixed material, comprising both fine and coarse material, can leave the grinding space, said second group of openings communicating with an individual material outlet via switching means by which the material mixture passing through said second group of openings can be prevented from leaving the mill, and classifying means for dividing said material mixture upstream of the outlet therefore into at least one coarse fraction and at least one finer fraction having a maximum particle size which is equal to or greater than the maximum particle size of said fine material. Means are provided for returning at least the major part of said finer fraction to the grinding space. In this way there is obtained an inexpensive and structurely simple arrangement, with which coarse material can be taken out in a controllable fashion without deleteriously influencing the grinding process in the mill. At the same time the arrangement requires but little space and is only subjected to wear by the material mixture, i.e. by a small part of the total amount of material taken from the mill.

Preferably, said second group of openings discharge into a sector-shaped space which is defined by said screening wall, said end wall and substantially radially extending defining walls arranged therebetween, and which is connected at its radially inner end to a pipe arranged within said discharge trunnion substantially coaxially therewith. The classifying means is formed by openings in the pipe wall, said openings discharging into a tubular part which encircles said pipe along at least a part of the length thereof and substantially coaxially therewith, and which has an open inner end discharging into said grinding space. Said tubular part may be of a substantially conically flared configuration and/or may be provided on the inner surfaces thereof with helically extending strips, for promoting the return of the finer material fraction separated by the classifying means, back to the grinding space.

According to one advantageous embodiment, said pipe may be open at both ends and the sector-shaped space may connect with an inner end of the pipe which is open towards the grinding space via a valve which can be switched to guide said material mixture either into the pipe or directly into the grinding space. With this arrangement, the classifying means will be subjected to wear from only that amount of material mixture whose coarse fraction is taken out from the mill.

Alternatively, said pipe may be closed at the end thereof facing the grinding space and be in constant communication with said sector-shaped space. The tubular part may be open at its outer end, and the ends of said pipe and said tubular part remote from the grinding space may be arranged to co-operate with a deflecting means which can be switched between a first position in which the classified material mixture arriving through said pipe is passed axially beyond the outer end of said tubular part, and a second position in which said classified material mixture is prevented from reaching said outer end. Although with this arrangement the classifying means is required to process all the material mixture discharged from the grinding space of the mill, the deflecting means can be greatly simplified and is subjected to wear only by the coarse fraction of the material mixture removed from the grinding space. Thus, the deflecting means may comprise a chute which is swingably mounted on a stationary holder located externally of the outer end of said tubular part, for movement between a first position in which it passes classified material mixture from the outer end of the tubular part, and a second position in which it uncovers the outer end of the pipe so that the classified material mixture falls from the outer end of the pipe down into said tubular part for return to the grinding space.

Other characterizing features of the invention and advantages afforded thereby will be apparent from the claims, and from the following description, which is made with reference to the accompanying drawings, in which FIG. 1 is an axial sectional view of part of the discharge end of an autogenous mill having an arrangement according to the invention.

FIG. 2 is a sectional view taken on the line II—II in FIG. 1.

FIG. 3 illustrates the deflecting means shown in FIG. 1, in larger scale and in a different position.

Figure 1:
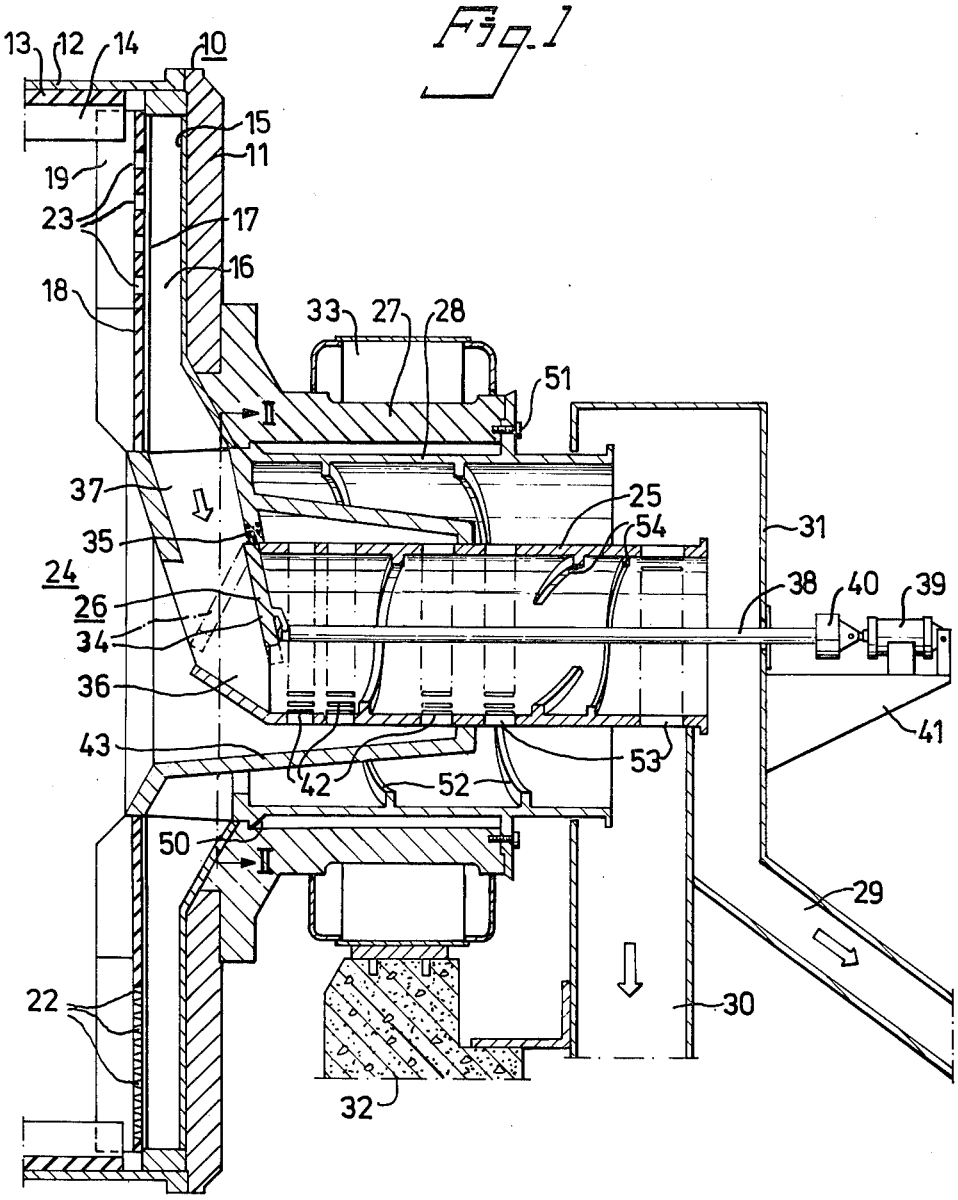

In FIGS. 1–3, which illustrate parts of the discharge end of a drum mill 10 intended for autogenous or semi-autogenous grinding, the references 11 and 12 identify respectively the end wall and shell of said mill at said discharge end. The shell or outer wall of the mill is lined internally with a rubber lining 13 and a plurality of carrier devices 14, so-called lifters, which project above the lining 13 and which are also made of rubber. The end wall 11 and other parts of the mill which come into contact with the material being ground are also lined with a wear resistant material, such as rubber. Extending from the lining 15 of the end wall 11, which lining comprises a plurality of substantially circle-sector shaped plates, are radially oriented webs 16 which carry on the edge surfaces thereof facing the interior of the mill flange portions 17, which in turn support a screening wall 18 comprising substantially circle-sector shaped rubber plates. The wall 18 is provided with a plurality of radially extending lifter elements 19 and defines, together with the webs 16 and the lining 15, a plurality of sector shaped spaces 20, 21 (FIG. 2). The screening wall 18 is provided with groups of openings 22, 23, the openings 22, which are relatively small and of which only a few are shown in FIG. 1, connect a plurality of said spaces 20 with the grinding space 24 of the mill and serve to continuously lead comparatively fine material ground in the mill out of the grinding space 24. The openings 23, which are relatively large and of which only a few are shown in FIG. 1, connect the space 21 with the ginding space 24 and serve to discharge a material mixture, comprising both relatively fine material and relatively coarse material, from the grinding space 24.

The space 21 which receives material through the openings 23 forms a passage for leading said material mixture towards the central region of the end wall 11 and opens into a centrally arranged material-discharge pipe 25 via a switching means generally shown at 26, by means of which switching means the flow of said material mixture from the space 21 can be deflected so that it is returned, either completely or in part, back to the grinding space 24. The pipe 25 shields the discharge flow of material mixture from the flow of fine material which is fed out of the grinding space 24 and which passes into the spaces 20 through the openings 22. The spaces 20 also form passages for leading the fine material towards the central region of the end wall 11, and open into a mill-trunnion liner pipe 28 which is arranged in the hollow mill-trunnion 27 and substantially coaxially surrounds the pipe 25. The pipe 25 extends axially beyond the pipe 28, and the pipes 25 and 28 open into mutually different discharge chutes or down-pipes 29 and 30 respectively of a stationary material-receiving device 31 connected to the discharge end of the mill trunnion 27, 28. The reference 32 identifies part of a support which carries the mill 10 at its discharge end, via a bearing means 33. A corresponding bearing means can be provided at the other end of the mill 10. Alternatively, the mill may be carried by bearings arranged to co-act with bearing races on the outer wall 12 at the opposite ends thereof.

The switching means 26 illustrated in FIGS. 1–3 comprises a flap valve having a substantially rectangular valve flap 34 which is pivotally mounted along one edge thereof. The flap 34 is hinged at 35 in a valve housing 36 formed in the inner end of pipe 25, said housing 36 communicating with the space 21 via a funnel-like part 37. For the purpose of switching the flap valve 34 between the position shown in full lines in FIG. 1, in which position the material mixture arriving from the space 21 is supplied to the pipe 25, and the position shown in dash lines, in which the material mixture arriving through the funnel-shaped part 37 is returned to the grinding space 24, the flap 34 is pivotally connected to one end of a rod-like element 38, whose other end is connected to the piston rod of a pressure cylinder 39, via a coupling which permits the rod-like element 38 to rotate and pivot relative to the piston rod. The rod-like element 38 extends freely through the pipe 25 between the flap 34 and the coupling 40. The cylinder 39 is carried by the material receiving device 31, via a bracket structure 41.

The pipe 25 is provided along a substantial part of its length with throug-passing slots or openings 42, the smallest cross-sectional size of which is equal to or greater than the smallest cross-sectional size of the openings 22, but smaller than the smallest cross-sectional size of the openings 23. The openings 42 open out into a tubular part 43 which encircles said pipe 25, substantially coaxially therewith, and which has an open inner end opening into the grinding space 24. Thus, when the flap valve occupies the position shown in full lines in FIG. 1, substantially all that material which accompanies the flow of mixed material removed from the grinding space and which is able to pass through the openings 42, will be separated from the flow of mixed material and returned to the grinding space 24 of the mill 10, so that substantially only relatively coarse material will depart from the mill, with the valve 34 in said position shown in full lines. The openings 42 thus form a classifying means, whereat the finer fraction separated by said classifying means is returned to the grinding space. In this way, the removal of coarse material from the mill 10 will not disturb the grinding process in the mill, by a sudden or abrupt increase in rate of discharge of pulp comprising fine material and water therefrom, or disturb the grinding process in a possible subsequent mill (not shown) which is arranged immediately after the mill 10, and in which the fine material taken out continously through the openings 22 is further ground with grinding media in the form of the coarse material removed from the mill, by a sudden increase in the charge of pulp comprising fine material and water to such a subsequent mill. In order to facilitate the return of the finer fraction passing through the openings 42, the tubular part 43 is flared substantially conically in a direction towards the grinding space 24. As an alternative to the conical shape of the part 43, or as an addition thereto, the inner surface of the part 43 may be provided with helically extending strips (not shown), for promoting the return of the finer fraction to the grinding space 24. The tubular part 43 is suitably closed at its end remote from the grinding space 24, in the manner shown in FIG. 1. The pipe 25 may also be provided, in the shown manner, with helical strips 54, for controlling the flow of coarse material to the downpipe 30.

The pipes 25 and 28, the valve housing 36 and the parts 37 and 43 form, to advantage, a unit which can be assembled externally of the mill and which can be inserted into the position shown in FIG. 1, and positioned by means of positioning means 50 in relation to the actual mill trunnion 27, and locked in position by means of locking devices 51.

Figure 4:
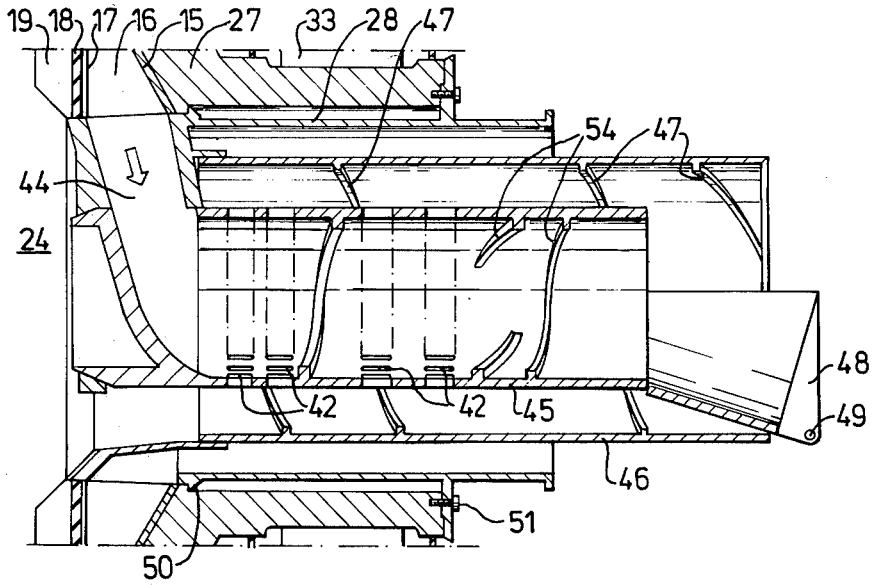
FIG. 4 is an axial sectional view of another embodiment of the arrangement according to the invention.

The alternative embodiment illustrated in FIG. 4 has no flap valve, and the space 21 opens at its radially inner end into a funnel-like element 44, which in turn opens into a pipe 45 whose end remote from the grinding space is closed and its opposite end open. As with the FIG. 1 embodiment, the pipe 45 is encircled by a pipe 28, which receives the fine material flowing continuously from the spaces 20. Extending coaxially with the pipes 45, 28 and arranged therebetween is a tubular part 46, which opens at both ends thereof. The inner end of tubular part 46 opens out into the grinding space 24, in order to return thereto the finer fraction of the mixed material arriving in the pipe 45 through the funnel-shaped element 44, said finer fraction being obtained from said mixed material through the openings 42 in the pipe 45. The outer end of the pipe 45 terminates inwardly of the open, outer end of the tubular part 46, which in turn extends axially outwardly of the pipe 28 and is provided with helically extending strips 47, for promoting the return of material back to the grinding space of the mill. Arranged in the outer end of the tubular part 46 is a deflecting means in the form of a chute 48 which is pivotally mounted at 49 on a stationary holder (not shown) located externally of the outer end of the tubular part for movement between a first position in which the chute leads the mixed material classified by means of the openings 42 away from the outer end of the pipe 45, and a second position in which the chute exposes the outer end of said pipe 45, so that subsequent to said classification residual coarse material falls from the outer end of the pipe 45, down into the tubular part 46, for return to the grinding space.

The invention is not restricted to the aforedescribed and illustrated embodiments, but can be modified within the scope of the claims. For example, the deflecting means can be arranged to close the funnel-shaped part 37 of the FIG. 1 embodiment or the outer end of the pipe 45 of the FIG. 4 embodiment when coarse material is not removed from the mill 10, and the discharge pipe 28 for fine material, as illustrated in FIG. 1, may be provided with helically extending strips 52, for assisting the discharge of fine material. Further, the pipe 25 for receiving said mixed material, may be provided with additional openings (as shown at 53 in FIG. 1), for conducting a minor part of the finer material to the pipe 28, or an intermediate fraction which is slightly coarser than said finer material to a further pipe (not shown) which encircles said pipe 25 and which conducts said intermediate fraction to a further chute or downpipe.

I claim:

1. A drum mill for autogenous or semi-autogenous wet-grinding processes and being of the type having a screening wall which is arranged adjacent a mill drum end wall provided with a hollow material-discharge trunnion and which separates said end wall from a grinding space within the mill, wherein said screening wall has at least one first group of relatively small grate openings through which fine material ground in the mill constantly leaves the grinding space and departs through the discharge trunnion, and at least one second group of relatively large openings through which mixed material, comprising both fine and coarse material, can leave the grinding space, said second group of openings communicating with an individual material outlet via switching means by which the material mixture passing through said second group of openings can be prevented from leaving the mill, and classifying means for dividing said material mixture upsteam of the outlet therefore into at least one coarse fraction and at least one finer fraction having a maximum particle size which is at least equal to the maximum particle size of said fine material, and wherein means are provided for returning at least a major part of said finer fraction to the grinding space.

2. A drum mill according to claim 1, wherein said second group of openings discharge into a sector-shaped space which is defined by said screening wall, said end wall and substantially radially extending defining walls arranged therebetween, and which is connected at its radially inner end to a pipe arranged within said discharge trunnion substantially coaxially therewith wherein said classifying means is formed by openings in a tubular wall defining said pipe, said openings discharging into a tubular part which encircles said pipe along at least a part of the length thereof and substantially coaxially therewith, and which has an open inner end discharging into said grinding space.

3. A drum mill according to claim 2, wherein the tubular part is flared substantially conically in a direction towards the grinding space.

4. A drum mill according to claim 2, wherein the tubular part is provided on the inner surface thereof with helically extending strips for promoting the return of the material received by said tubular part to the grinding space.

5. A drum mill according to claim 2, wherein said pipe is open at both ends, and wherein the sector-shaped space connects with an inner end of the pipe which is open towards the grinding space via a valve which can be switched to guide said material mixture either into the pipe or directly into the grinding space.

6. A drum mill according to claim 2, wherein said pipe is closed at the end thereof facing the grinding space and is in constant communication with said sector-shaped space, and wherein the tubular part is open at its outer end, and wherein the ends of said pipe and said tubular part remote from the grinding space are arranged to co-operate with a deflecting means which can be switched between a first position in which the classified material mixture arriving through said pipe is passed axially beyond the outer end of said tubular part, and a second position in which said classified material mixture is prevented from reaching said outer end.

7. A drum mill according to claim 2, wherein the outer end of said pipe extends axially beyond the outer end of the material discharge trunnion.

8. A drum mill according to claim 7, wherein the outer end of said pipe is located axially inwardly of the outer end of the tubular part.

9. A drum mill according to claim 8, wherein the deflecting means comprises a chute which is swingably mounted on a stationary holder located externally of the outer end of said tubular part, for movement between a first position in which it passes classified material mixture from the outer end of the pipe out beyond the outer end of the tubular part, and a second position in which it uncovers the outer end of the pipe so that the classified material mixture falls from the outer end of the pipe down into said tubular part for return to the grinding space.

* * * * *